United States Patent [19]

McKim, Jr.

[11] Patent Number: 4,707,011

[45] Date of Patent: Nov. 17, 1987

[54] HANDLE ATTACHMENT FOR CARDBOARD BOXES

[76] Inventor: Richard L. McKim, Jr., P.O. Box 521306, Miami, Fla. 33152

[21] Appl. No.: 818,350

[22] Filed: Jan. 13, 1986

[51] Int. Cl.[4] ..... B25B 7/02

[52] U.S. Cl. ..... 294/16; 294/31.1; 229/52 AM

[58] Field of Search ..... 294/16, 148, 164, 167, 294/169, 26.5, 31.1, 31.2, 27.1, 33; 229/52 AM, 52 AW, 52 A, DIG. 6

[56] References Cited

U.S. PATENT DOCUMENTS 3,017,214 1/1962 Pape ..... 294/31.1
3,169,034 2/1965 Epstein ..... 296/16
3,583,745 6/1971 Stuart, Jr. ..... 294/31.1
4,109,952 8/1978 Monzain .
4,226,349 10/1980 Uccellini ..... 229/52 AM

*Primary Examiner*—James B. Marbert
*Attorney, Agent, or Firm*—John Cyril Malloy

[57] ABSTRACT

A handle attachment structure primarily designed for use for the gripping of opposite sides, but at least one side wall, of a cardboard or like penetrable material box of the type intended to carry computer paper or like material and including two leaves at least one of which is provided with supporting teeth on its inwardly facing surface thereof for the penetrating engagement of the side wall of the box. A handle means is movably attached to the leaves and is selectively positionable into and out of a coplanar position with the wall being gripped, the latter coplanar position defining a lifting position of the handle relative to the box and leaves.

12 Claims, 4 Drawing Figures

HANDLE ATTACHMENT FOR CARDBOARD BOXES

BACKGROUND OF THE INVENTION

1. Field of the Invention

The present invention relates to handle attachments for cardboard boxes, and more particularly, to handle attachments with spring loaded leaves.

2. Description of the Prior Art

It is common to see cardboard boxes full of computer paper in the modern offices. Printers guzzle an enormous amount of paper everyday requiring the movement of these relatively heavy boxes frequently. This task is usually done by female clerks and broken fingernails is frequently the aftermath. A known prior art structure directed to a package lifting assembly is disclosed in U.S. Pat. No. 4,109,952 issued to Monzain in 1978. Monzain's package lifter describes two laterally spaced pairs of jaw levers, including gripping members, that are adapted to grip a case interposed between the jaw levers. For computer paper boxes, however, this mechanism would need to be removed each time that the paper is going to be used in order for the paper to be able to be pulled out. Also, it requires considerable gripping pressure on the part of the user which is incompatible with the average female computer operator.

Other patents disclosing related subject matter provide for a number of more or less complicated features that fail to solve the problem in an efficient and economical way. However, it is believed that none of these patents suggest the novel features of the present invention.

SUMMARY OF THE INVENTION

It is the main object of the present invention to provide a handle attachment for cardboard boxes that may be easily removably attached to the side walls of the boxes with a minimum profile.

It is another object of the present invention to provide such a handle attachment that may be attached to the side wall of the cardboard box.

It is yet another object of the present invention to provide a simple handle attachment that requires only a slight force on the part of the user to install said handle to the cardboard box.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention comprises in the details of construction and combination of parts as will be more fully understood from the following description, when read in conjunction with the accompanying drawings in which.

DETAILED DESCRIPTION OF THE PREFERRRED EMBODIMENT

Figure 1:
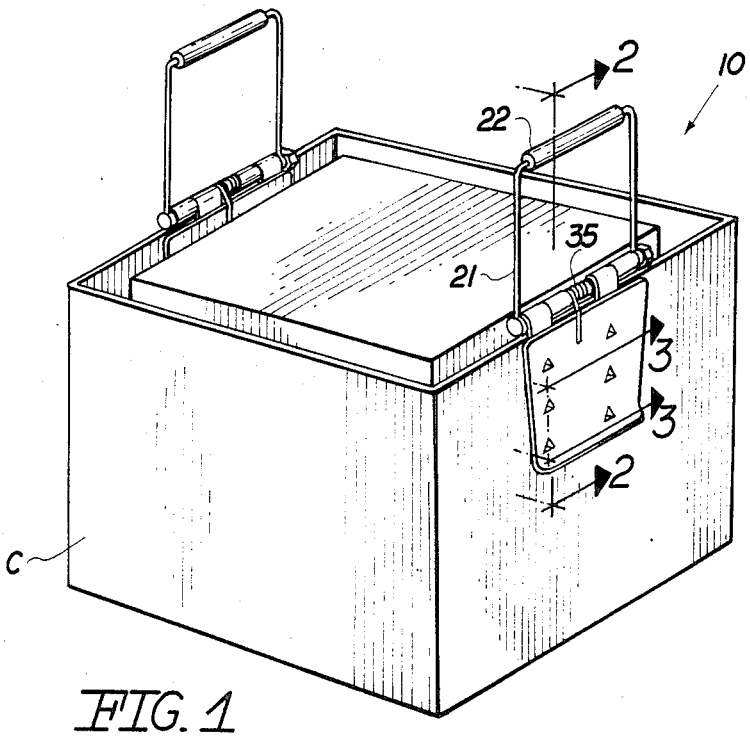
FIG. 1 represents an isometric view of a computer paper box with the present invention attached to the side walls of the box.
Figure 2:
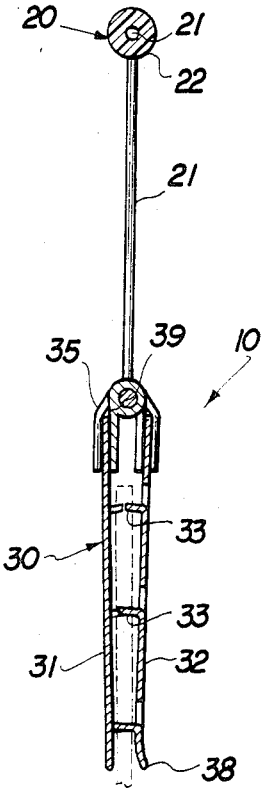
FIG. 2 shows a side view of the present invention.
Figure 3:
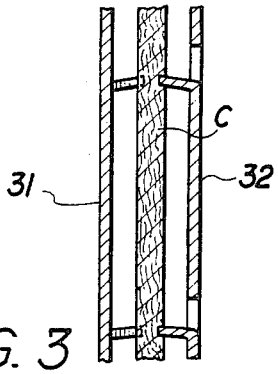
FIG. 3 illustrates a partial detail view of the cardboard box being sandwiched by the two leaves of the present invention.
Figure 4:
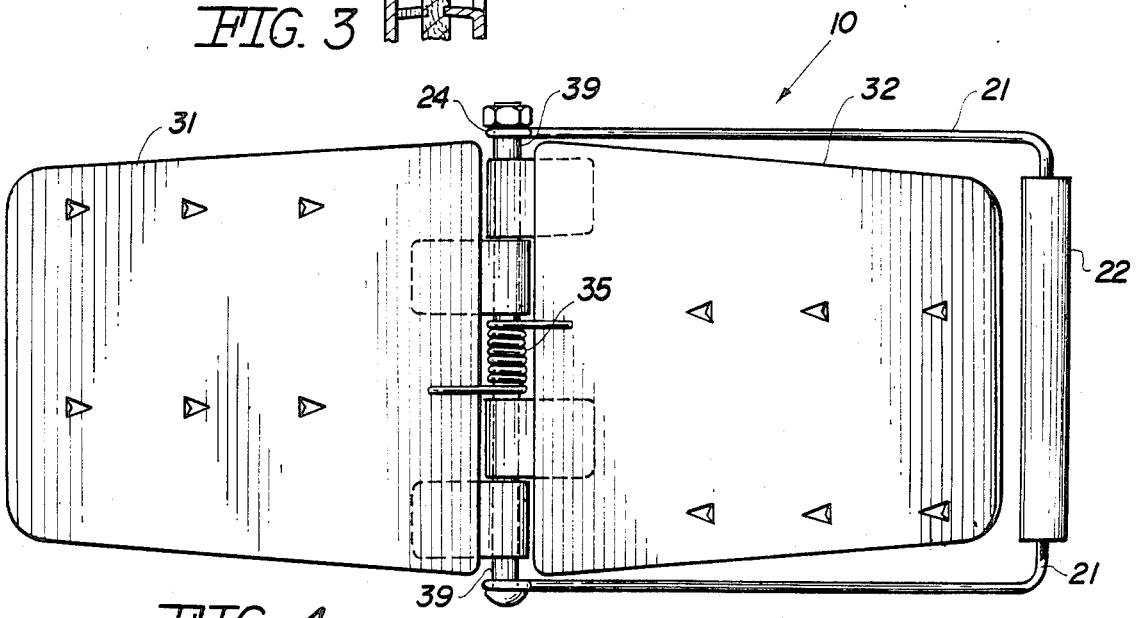
FIG. 4 is a representation of the invention with the leaves extended out.

Referring now to the drawings, where the present invention is generally referred to with number 10, it can be With reference to FIGS. 1–4, the handle attachment 10 of the present invention comprises, basically, of two assemblies: handle assembly 20 and hinge assembly 30. Hinge assembly 30 has inner leaf 31 and outer leaf 32 that are urged towards each other by virtue of spring assembly 35. Several teeth 33 are scattered throughout the facing surfaces of inner and outer leaves 31 and 32. Teeth 33, in the preferred embodiment, have a triangular shape with a sharp pointed end substantially perpendicularly disposed with respect to the surfaces of leaves 31 and 32 so that a resting triangular surface of teeth 33 support the distributed weight of box C. Teeth 33, aided by spring assembly 35, penetrate inside the walls of cardboard box C thereby providing a firm grip between both leaves 31 and 32 and the corresponding side of the box being gripped. It is important to note that the base of the triangularly shaped teeth 33 are at the bottom and the apexes at the top so that the teeth 33 are less susceptible to being bent by the weight of box C than if the orientation were reversed. As shown in FIGS. 1 and 2, the handle means as shown is disclosed in a substantially upright, substantially coplanar orientation to the side wall (shown in phantom lines in FIG. 2) and therefore this upright, coplanar position obviously define the position best suited for carrying or lifting the box. Also, FIG. 4 shows the bent axle portion 21 pivotal about an elongated central axle 39 of the hinge means as at 24 of the handle means. Accordingly, it is clear that the handle means is selectively positionable due to its pivotal connection relative to the elongated axle 39 between an upright, substantially coplanar position as shown in FIGS. 1 and 2 and a non-coplanar position as shown in FIG. 4.

Inner leaf 31 terminates straight down so that it can be easily inserted between the inner surface of the computer paper box C and the stack of paper it contains. Outer leaf 32, on the other hand, includes a lifted end portion 38 that is intended to facilitate the pulling apart of outer leaf 32. Lifted end portion 38 allows females with long fingernails to operate the device 10 without breaking their nails. as best shown in FIGS. 2 and 4 the handle means 20 includes handle member 22 which is, in the preferred embodiment, rotatably mounted on handle axle 21 which bends downwardly and is pivotally supported on the hinge axle 39 which is journalled to the curved termination 24 of axle 21 (FIG. 4).

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A handle attachment for a cardboard box having at least one flat side wall, comprising:

(a) an inner leaf and outer leaf removably connected to the flat side wall and at least partially defining a hinge means for movably interconnecting said inner and outer leaves to one another, (b) each leaf including a facing surface positioned to engage a corresponding one of an inner and outer surface of the flat wall, a plurality of teeth formed on at least one of said facing surfaces and extending angularly outwardly therefrom and into penetrating engagement with the corresponding surface of the flat side wall, (c) said hinge means further including spring means disposed in biasing relation to said inner and outer leaves for urging said leaves towards each other, whereby said plurality of teeth are forced into penetrating engagement with the flat side wall, and (d) handle means for lifting the box pivotally connected to said hinge means and selectively positionable into and out of a substantially coplanar position relative to the side wall, said substantially coplanar position of said handle means relative to the flat side wall defining a lifting position of said handle means and said handle means being swingable into overlaying relation of the box wall defining a stored position.

2. The handle attachment set forth in claim 1 wherein said handle means includes an axle with a rotatably mounted handle member thereon.

3. A handle attachment as in claim 1 wherein at least said outer leaf comprises a substantially flat, planar configuration over a majority of a length thereof.

4. A handle attachment as in claim 3 wherein both said inner leaf and said outer leaf comprise a substantially flat, planar configuration extending over a majority of a length of each leaf.

5. A handle attachment as in claim 4 wherein said plurality of teeth are disposed in spaced relation to one another substantially over said flat, planar configuration and outwardly from said respective facing surface of each inner leaf and outer leaf.

6. A handle attachment as in claim 3 wherein the swingable end of said outer leaf includes a lifted end portion extending outwardly from said flat planar configuration and away from the flat side wall.

7. A handle attachment as in claim 5 wherein each of said plurality of teeth have a substantially triangular shape and are disposed and configured to provide a resting and lifting surface on said substantially flat, planar configuration of said respective leaf for the weight of the box.

8. A handle attachment as in claim 7 wherein each of said plurality of teeth are punched out of said respective leaves and include a base of the triangular shape on a bottom portion thereof which is integral with said respective leaf and at a substantially angular orientation to said leaf so as to extend outwardly from said facing surface and further wherein the apex of the triangular shape is disposed at an outermost extremity of each of said respective teeth.

9. A handle attachment as in claim 1 wherein said hinge means comprises an elongated axle structure, said inner and outer leaves both pivotally attached to said axle structure, said handle means pivotally secured to said axle substantially at one end of said handle means, said axle disposed to define a common pivotal axis for each of said inner and outer leaves and said handle means.

10. A handle attachment as in claim 9 wherein said spring means is secured to said axle in biasing engagement with both said inner and outer leaves and in spaced relation to said handle means.

11. The handle attachment as in claim 1 wherein said plurality of teeth formed on at least one of said facing surfaces is on said inner leaf.

12. A handle attachment as in claim 1 wherein said outer leaf includes mutually intercooperating means on the facing surface of said outer leaf to engage said flat side wall and cooperate with said plurality of teeth for gripping said flat side wall.

* * * * *